US005926665A

United States Patent [19]

Suzuki

[11] Patent Number: 5,926,665

[45] Date of Patent: Jul. 20, 1999

[54] IMAGE FORMING APPARATUS

[75] Inventor: Jun Suzuki, Numazu, Japan

[73] Assignee: Canon Kabushiki Kaisha, Tokyo, Japan

[21] Appl. No.: 08/780,682

[22] Filed: Jan. 8, 1997

[30] Foreign Application Priority Data

Jan. 9, 1996 [JP] Japan ..... 8-018092

[51] Int. Cl.[6] ..... G03G 15/00

[52] U.S. Cl. ..... 399/25; 399/43; 399/79

[58] Field of Search ..... 399/24–26, 79–80, 399/89, 43

[56] References Cited

U.S. PATENT DOCUMENTS

| | | | |
|---|---|---|---|
| Re. 35,751 | 3/1998 | Midgley | 399/25 |
| 4,111,544 | 9/1978 | Steiner . | |
| 4,961,088 | 10/1990 | Gilliland et al. | 399/25 |
| 5,034,770 | 7/1991 | O'Connell | 399/79 |
| 5,101,233 | 3/1992 | Ito et al. | 399/24 |
| 5,283,613 | 2/1994 | Midgley Sr. | 399/9 |
| 5,452,059 | 9/1995 | Sekiya | 399/25 |
| 5,572,292 | 11/1996 | Chatani et al. | 399/25 |

FOREIGN PATENT DOCUMENTS

| | | |
|---|---|---|
| 59-61854 | 4/1984 | Japan . |
| 6-149051 | 5/1994 | Japan . |
| 2 234 467 | 2/1991 | United Kingdom . |

OTHER PUBLICATIONS

Jap. Pat. Abs., vol. 015, No. 499 (P–1289), Dec. 17, 1991 (JP 03–216666 A).

Brown, B.D., "Multiplexed Current Loops for Analog Data Transmission", Xerox Disclosure Journal, vol. 17, No. 2, Mar./Apr., 1992, pp. 91–93.

*Primary Examiner*—Matthew S. Smith

*Attorney, Agent, or Firm*—Fitzpatrick, Cella, Harper & Scinto

[57] ABSTRACT

An image forming apparatus includes an image forming device for forming an image on a recording material, a high voltage electric power source for driving the image forming device, a storing device for storing information related to image formation, and an information inputting/outputting device for inputting the information into the storing device, or outputting it therefrom, by accessing the storing device. The inputting/outputting device accesses the storing device when the high voltage electric power source is not in operation.

6 Claims, 8 Drawing Sheets

IMAGE FORMING APPARATUS

FIELD OF THE INVENTION AND RELATED ART

The present invention relates to an image forming apparatus such as a copying machine or a printer. In particular, it relates to an image forming apparatus comprising a storing means for storing information, such as print count, data for controlling processing devices within the image forming apparatus, and the like, which are related to image formation.

Japanese Laid-Open Patent Application No. 61854/1984 discloses an image forming apparatus comprising a storing means for storing the information related to image formation. In the case of this image forming apparatus, a non-volatile RAM is mounted in a process cartridge, and the amount of process cartridge usage in the main assembly of the image forming apparatus is stored in this non-volatile RAM. The stored information is used to determine whether the limit on the life of the process cartridge has been reached, so that a user can be informed of process cartridge replacement timing.

Also, Japanese Laid-Open Patent Application No. 149051/1994 proposes an additional usage of the non-volatile RAM to protect the main assembly of the image forming apparatus. More specifically, a quality code is stored in the non-volatile RAM, and image formation is rendered impossible unless the quality code on the apparatus main assembly side matches the quality code stored in the non-volatile RAM of a process cartridge.

In either case, information is accurately exchanged between the storage medium mounted in a process cartridge, and an image forming apparatus, wherein the exchanged information is used to improve the functions of the process cartridge and the image forming apparatus.

The information exchange between the storage medium mounted in a process cartridge, and an information inputting/outputting means, mounted in an image forming apparatus to exchange information with the storage medium of the process cartridge, is dependent on an extremely weak information signal, such as an electric current of the order of $\mu$m A. This cannot be avoided regardless of the type of the storage medium mounted in a process cartridge, as long as the control information, the status information, and the like within the main assembly of an image forming apparatus are transmitted using a weak electric current.

On the other hand, in order to provide a high voltage AC bias and a high voltage DC bias, which are necessary for image formation, a high voltage electric power source is mounted in an image forming apparatus. When a high voltage electric power source, in particular, an AC power source for generating an AC voltage comprising an oscillating component, is in operation, noises are frequently generated.

As for a countermeasure for the noises, it is quite common that a shield is placed in such a manner to surround a high voltage electric power source and the peripheral circuit thereof. In order to obtain a perfect shield effect so that no noise in released, it is necessary to establish a shield by placing a substantially thick member at a location which is a proper distance away from the high voltage power source.

However, it seems that the size of an image forming apparatus has been continuously reduced in recent years, and therefore, the space which a high voltage electric power source is allowed to occupy has been also reduced. Because of this kind of background, it is rather difficult to set up an ideal shield. In other words, presently, it is virtually impossible to completely eliminate the noise.

Therefore, it is feared that the noise generated by a high voltage electric power source interferes with the weak signal used to exchange information between the aforementioned storage medium mounted in a process cartridge, and the information inputting/outputting means mounted in an image forming apparatus to input information into the aforementioned storing means, or output information therefrom. As a result, accurate information exchange is prevented The provision of a shield along the information signal transmission path is also effective for preventing noise interference with the information signal. However, in order to make a process cartridge removably installable in an image forming apparatus, a portion of the aforementioned information signal transmission path must be constituted of a connector, a sliding electrode, or the like, and it is rather difficult to effectively shield this portion. Further, in order to completely shield the noise, a countermeasure, such as employing a shielded connector for connecting a personal computer to its peripheral devices, must be used. The employment of such a connector is expected to increase the apparatus cost enormously.

As is evident from the above explanation, in the case of an image forming apparatus structured in such a manner that an information storing means is disposed in a process cartridge, the distance between a high voltage application point and the information storing means is short. Therefore, it is extremely important to employ a noise counter measure.

SUMMARY OF THE INVENTION

The present invention was made in consideration of the problem described above, and its primary object is to provide an Image forming apparatus in which the noise generating from a high voltage electric power source does not interfere with an information signal exchanged between an information storing means and an information inputting/outputting means.

Another object of the present invention is to provide an image forming apparatus which has noise counter measures low in the cost.

According to an aspect of the present invention, an image forming apparatus comprises: image forming means for forming an image on a recording material; a high voltage electric power source for driving the image forming means; storing means for storing information related to image formation; and information inputting/outputting means for inputting the information into the storing means, or outputting it therefrom, by accessing the storing means, wherein the inputting/outputting means accesses the storing means means when the high voltage electric power source is not in operation.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, an electrophotographic image forming apparatus in accordance with the present invention will be described in more detail with reference to the drawings.

Embodiment 1

To begin with, referring to FIGS. 2 and 3, the electrophotographic image forming apparatus in the first embodiment, in which the process cartridge structured in accordance with the present invention is installable will be described.

Figure 2:
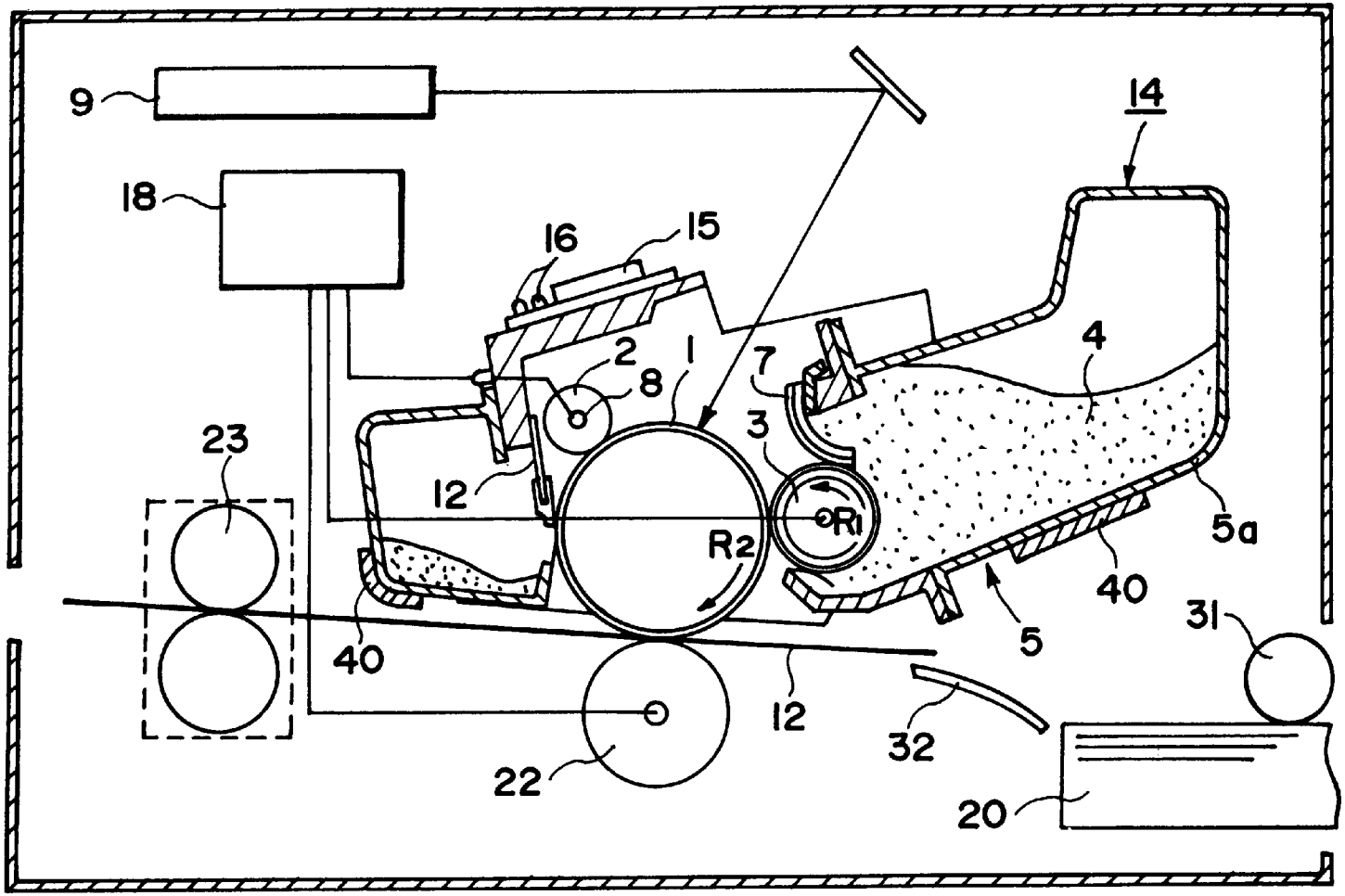
FIG. 2 is a sectional view of the image forming apparatus in a preferred embodiment of the present invention, depicting the general structure thereof.
Figure 3:
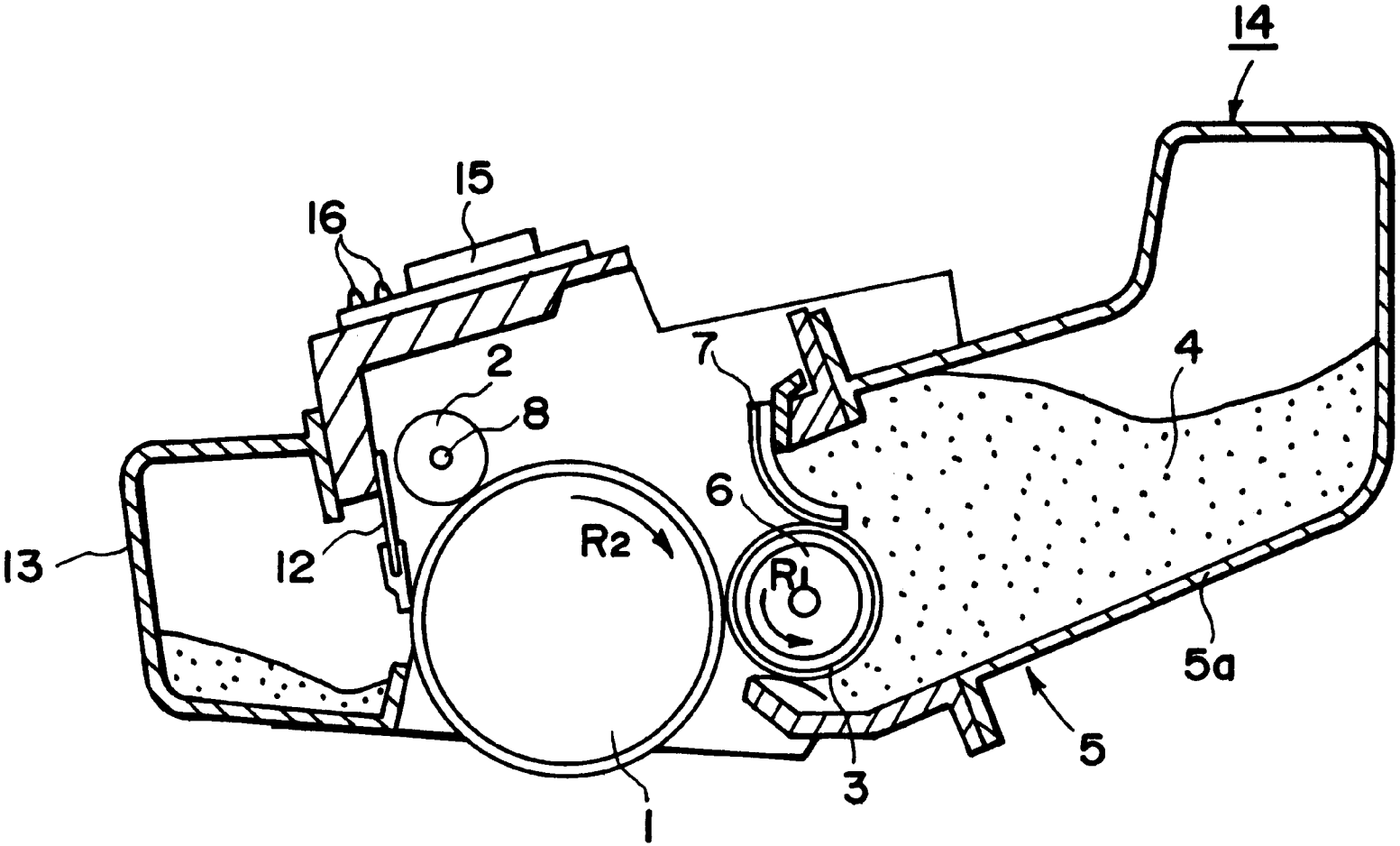
FIG. 3 is a sectional view of a process cartridge compatible with the image forming apparatus in the preferred embodiment, depicting the general structure thereof.

In FIGS. 2 and 3, a photosensitive drum 1 is surrounded by a charge roller 2 as a contact type charging means, a development roller 3 as a developer carrying member, a transfer roller 10, and a cleaning blade 12 as a cleaning means for removing the residual toner from the photosensitive drum 1. The development roller 3 is formed of a piece of aluminum pipe or the like.

In the process cartridge 14 illustrated in FIG. 3, the photosensitive drum 1, the charge roller 2, the developing apparatus 5, and the elastic cleaning blade 12 as the cleaning means, are integrally united These components such as the photosensitive drum 1, arm positioned in the process cartridge 14 so that the positional relationship among them meets predetermined specific requirements. For example, the process cartridge 14 must be inserted into, or removed from, a predetermined section (accommodating means 40) within the main assembly of the image forming apparatus, following a predetermined procedure.

The process cartridge 14 in this embodiment is characterized in that it comprises a storage medium 15 into which optional information can be inputted from the main assembly of an image forming apparatus, and from which the optional information can be read by the main assembly of the image forming apparatus, wherein control is executed in such a manner that information is inputted into the storage medium 15, or outputted therefrom, only when the high voltage electric power source mounted in the main assembly of the image forming apparatus is not in operation.

In this embodiment, a non-volatile RAM with a storage capacity of 2 K bytes is employed as the storage medium 15. However, the storage medium 15 may be constituted of other storage media such as a magnetic storage medium or an optical storage medium or a semiconductor memory. Further, the content to be stored in the storage medium 15 is information depicting the condition of the image forming apparatus.

The toner 4 in the toner containing portion 5*a* is conveyed to the surface of the photosensitive drum 1. During this conveyance, the toner 4 is regulated in its thickness and also is charged, by the development roller 3 rotating in the direction of the arrow mark R1 in FIG. 2, and the elastic blade 7.

On the other hand, the photosensitive drum 1 is rotated in the direction of the arrow mark R2 in FIG. 2 at a peripheral velocity of 40 revolutions per minute while a bias voltage composed by superposing a DC voltage of −600 V, and an AC voltage, in the form of a sine wave having a peak-to-peak voltage of 1600 V and a frequency of 300 Hz, is applied from the image forming apparatus main assembly side through a charge roller 2. As a result, the surface of the photosensitive drum 1 is charged to approximately −600 V. Then, a latent image is drawn on the charged photosensitive drum 1 by a beam of light projected from the laser beam projecting apparatus 9 provided on the image forming apparatus main assembly side.

Also, a bias voltage composed by superposing a DC voltage of −500 V and an AC voltage in the form of a sine wave having a peak-to-peak voltage of 1600 V and a frequency of 1700 Hz, is applied to the development roller 3 from the high voltage electric power source 18 mounted on the image forming apparatus main assembly side. As a result, the toner 4 is caused to shuttle between the photosensitive drum 1 and the development roller 3. At this point of an image forming operation, the actual potential at the surface of the photosensitive drum 1 is negative in both the light portion and the dark portion of the latent image, and the toner 4 adheres to the surface of the photosensitive drum 1, being distributed by the amount proportional to the potential; in other words, the latent image is developed.

Meanwhile, a recording sheet 12, as a recording medium, held in a sheet feeder cassette 20, is conveyed by a sheet feeder roller 31 and a conveying means, into the nip formed by the photosensitive drum 1 and a transfer roller 22. In the nip, a DC bias of approximately +2 kV is applied to the back side of the recording sheet 12 from the high voltage electric power source 18, whereby the toner image is transferred onto the surface of the recording sheet 12. Thereafter, the recording sheet 12 is conveyed into the fixing device 23, in which a fixed image is completed on the recording sheet 12.

The toner 4 remaining on the photosensitive drum 1 after image transfer is scraped off by the cleaning blade 12 before the photosensitive drum 1 is charged next time. The scraped toner 4 is collected in a waste toner container 13.

The information regarding the image forming apparatus condition is inputted into the storage medium 15 of the process cartridge 14 through an information transmission contact point 16. In this embodiment, a simple sliding electrode 16 shown in FIG. 4, which is not equipped with a special shield, is employed as the information transmission contact point.

Figure 1:
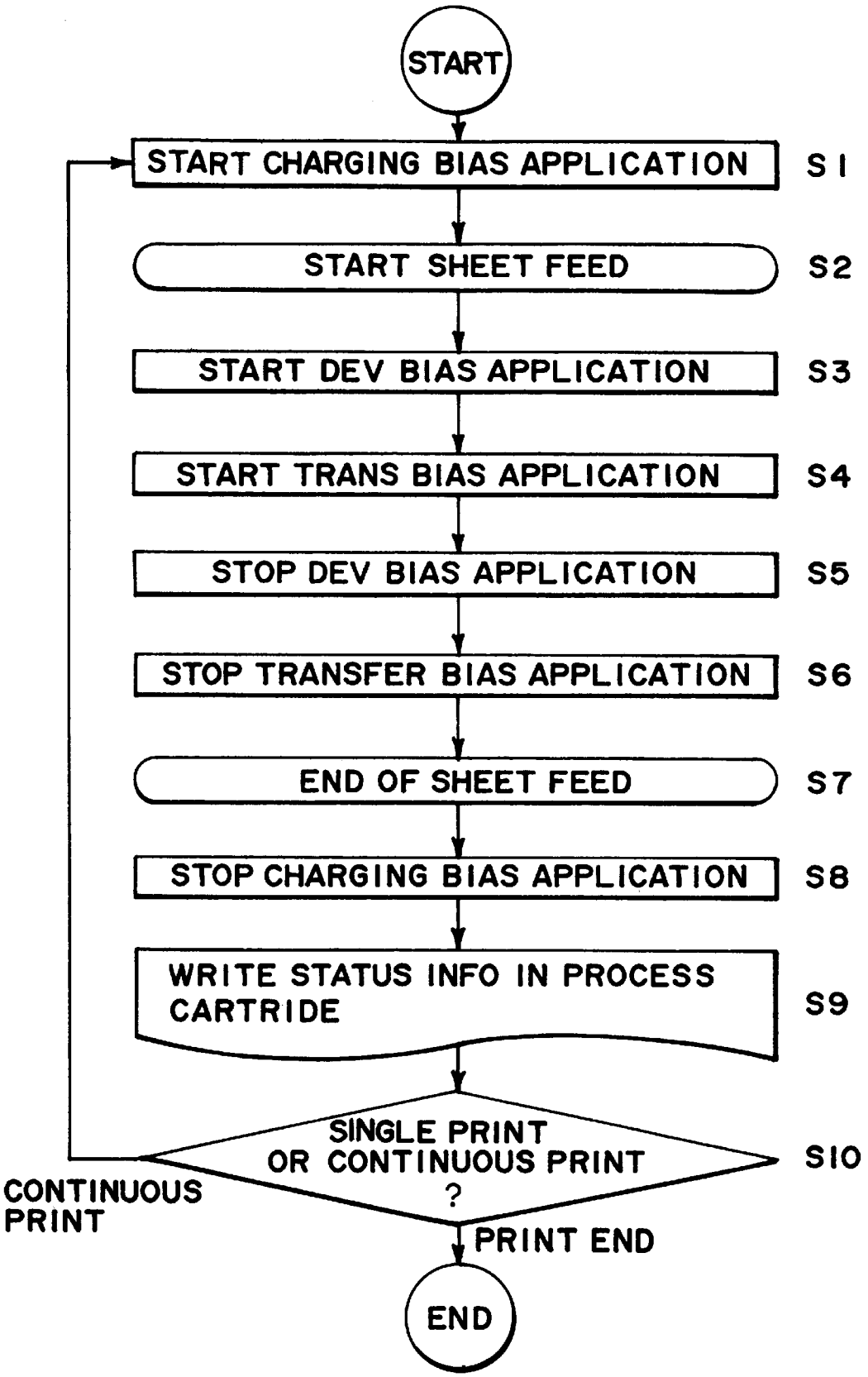
FIG. 1 is a flow chart showing the control flow for continuous image formation.

Referring to the flow chart of FIG. 1, an image forming apparatus comprising the process cartridge 14 In this embodiment carries out steps of applying a charge bias (S1), conveying the recording sheet (S2), applying a development bias (S3), and applying a transfer bias (S4), in this order, and then, stops applying the charge bias (S5) after stopping the application of the development bias (S5), stopping the application of the transfer bias (S6), and completing the recording sheet conveyance (S7). Thereafter, the information regarding the condition of the image forming apparatus is written into the storage medium 15 of the process cartridge 14 for the first time (S9). Next, a decision is made as to whether or not printing is to be continued (S10). When it is determined that printing is to be continued, the charge bias is applied again to charge the surface of the photosensitive drum 1, preparing it for the following image formation.

As described above, in the case of the process cartridge 14 in this embodiment, since the information concerning the condition of the image forming apparatus is inputted into the storage medium 15 of the process cartridge 14 when the high voltage electric power source 18, which is the main source of the noise, is not in operation, the weak signal used for information transmission is not subjected to the interference from the noise. Therefore, there is no need for the noise interference preventing means to be disposed along the information transmission path between the storage medium 15 and the information inputting/outputting means mounted in the image forming apparatus. Thus, it is possible to provide an inexpensive yet highly functional process cartridge, and an image forming apparatus comprising such a process cartridge.

Embodiment 2

Figure 5:
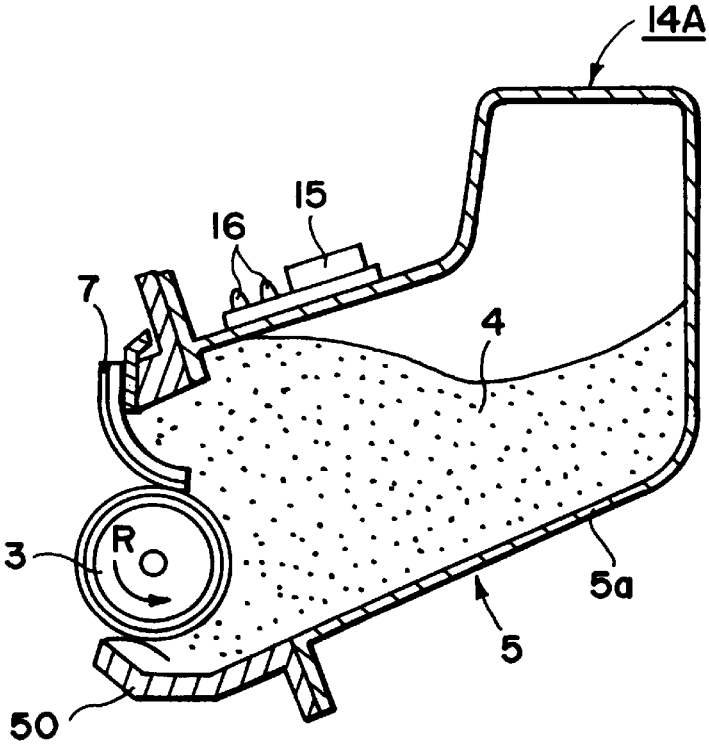
FIG. 5 is a sectional view of a developing apparatus compatible with the image forming apparatus in a second embodiment of the present invention, depicting the general structure thereof.

FIG. 5 depicts another embodiment of the present invention, that is, a developing apparatus 14A in the form of a cartridge.

In the developing apparatus 14A in this embodiment, a developer carrier member 3 like a development roller, and a developing means 5 comprising a developer (toner) storage portion 5*a* for containing toner 4 to be supplied to the developer carrier member 3, are integrally disposed in a plastic frame 50. In other words, the developing apparatus 14A in this embodiment may be considered to be substantially the same process cartridge as the process cartridge 14 described in the first embodiment, except for the absence of the photosensitive drum 1. In other words, the structures and functions of the toner storage portion 5*a* and the like in this embodiment are identical to those in the first embodiment, and are designated with the same referential symbols as those in the first embodiment, in order to substitute the descriptions in the first embodiment for the descriptions for those in this embodiment.

Embodiment 3

Figure 6:
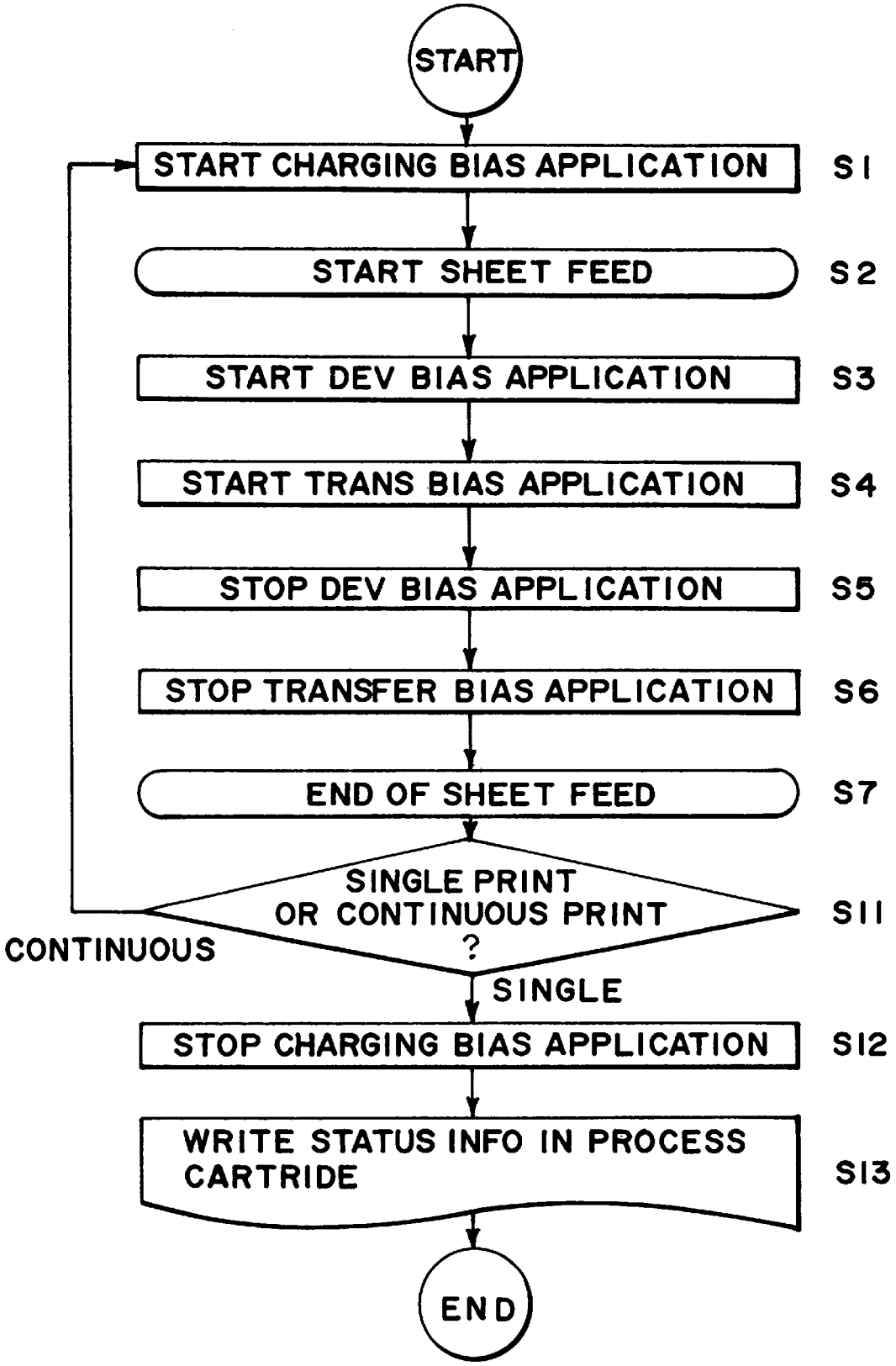
FIG. 6 is a flow chart for a third embodiment of the present invention, showing the control flow for continuous image formation.

Next, referring to FIGS. 6 and 7, the image forming apparatus and process cartridge in the third embodiment of the present invention will be described.

Figure 7:
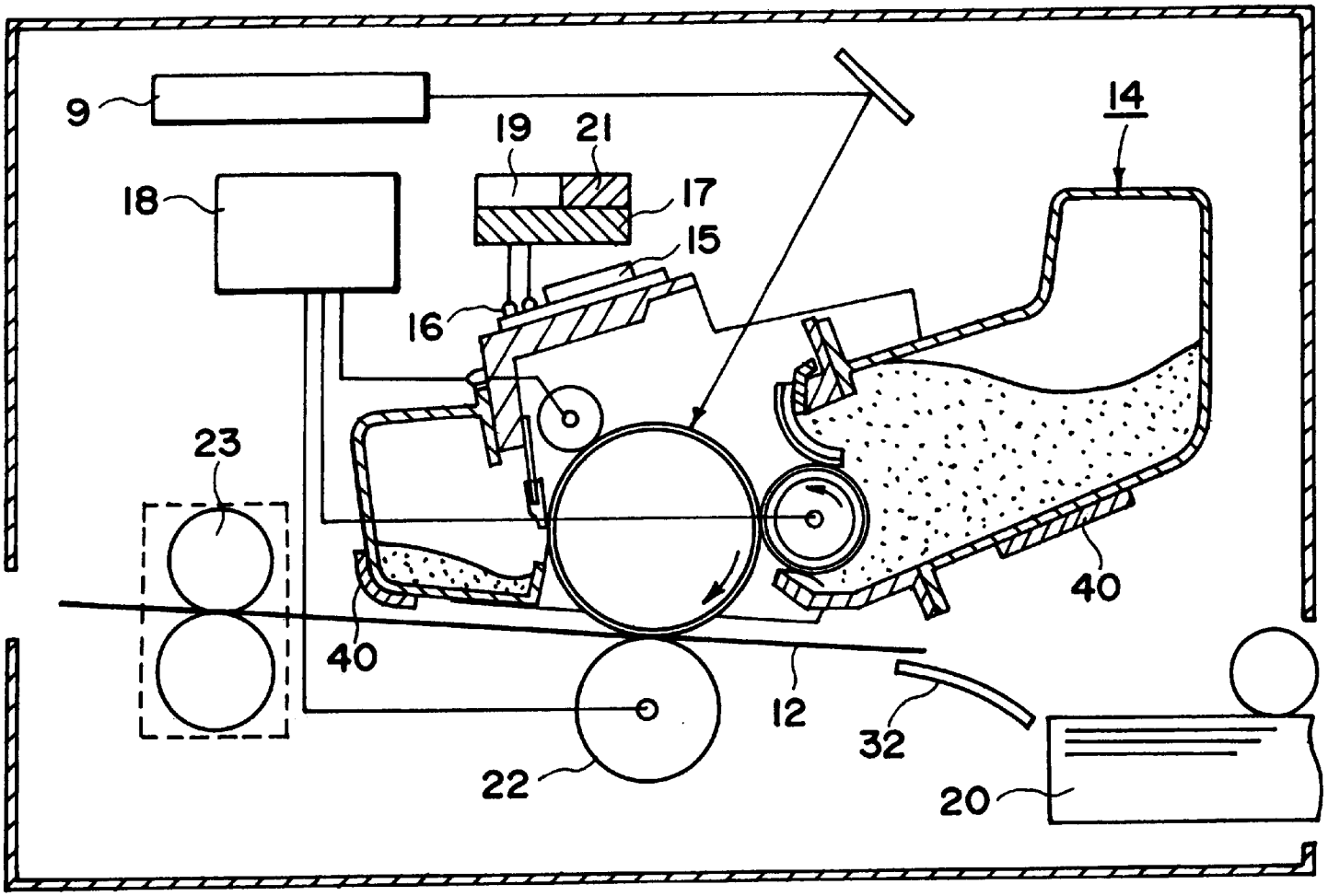
FIG. 7 is a sectional view of the image forming apparatus in the third embodiment of the present invention, depicting the general structure thereof.

Referring to FIG. 7, the image forming apparatus In this embodiment is such an image forming apparatus that removably comprises the process cartridge in the first embodiment to carry out an image forming operation. It is characterized in that it comprises a means 17 for inputting information into the storage medium 15 of the process cartridge 14, or output it therefrom, wherein it is controlled in such a manner that information is inputted into the storage medium 15, or outputted therefrom, only when the high voltage 18 mounted in the image forming apparatus main assembly is not in operation.

The image forming apparatus in this embodiment comprises a high voltage electric power source 18 for bias application, a laser scanner 9 for the formation of a charged latent image, a CPU 19, and a control ROM 21. Also, on the premise that in order to form an image, the process cartridge 14 in the first embodiment must be installed in the image forming apparatus main assembly, a sheet feeder cassette 20 for storing a recording sheet 12 as recording medium, a transfer roller 22 for transferring a toner image onto the recording sheet 12, and a fixing device 23 for fixing the toner image to the recording sheet 12 are properly positioned in the image forming apparatus.

The CPU 19 controls an image formation sequence comprising bias application, recording sheet conveyance, and the like, on the basis of the control information stored in the control ROM 21.

The content to be stored in the storage medium 15 is such information that depicts the condition of the image forming apparatus.

Figure 4:
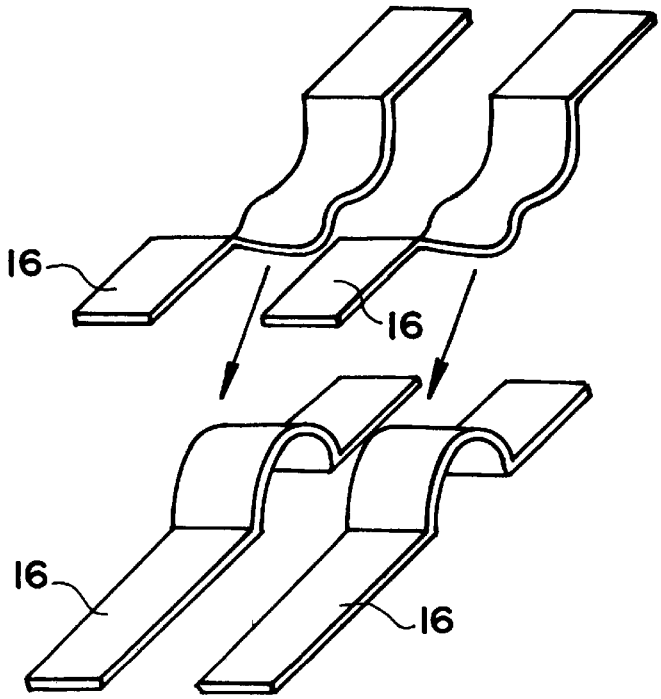
FIG. 4 is a perspective view of an information transmission contact point.

The information regarding the condition of the Image forming apparatus is inputted Into the storage medium 15 mounted in the process cartridge 14 by the information inputting/outputting means 17, through a simple information transmission contact point 16 illustrated in FIG. 4. This information transmission contact point 16 makes contact with the contact point provided on the process cartridge 14 side, with a predetermined contact pressure, as the process cartridge 14 is installed into the main assembly of the image forming apparatus.

As depicted by the flow chart in FIG. 4, the image forming apparatus in this embodiment carries out the steps of applying a charge bias (S1) to completing the recording sheet conveyance (S7) in the same manner as the image forming apparatus in the first embodiment. Thereafter, it makes a decision as to whether or not printing is to be continued (S11). When it determines that printing is not to be continued, it stops the charge bias application (S12), and writes the information regarding the apparatus condition into the storage medium 15 for the first time (S13).

As is evident from the above description, the image forming apparatus in this embodiment is controlled by the CPU 19 in such a manner that the information concerning the condition of the image forming apparatus is inputted into the storage medium 15 of the process cartridge 14 for the first time after continuous printing of a predetermined number of copies is completed, and the application of the charge bias, the development bias, and the transfer bias is stopped.

After the operation for inputting the information regarding the apparatus condition into the storage medium 15 is finished, the CPU 19 issues again an instruction for applying the charge bias, so that the surface of the photosensitive drum 1 is charged to be prepared for the following image formation.

In this embodiment, since the information depicting the condition of the image forming apparatus is inputted in the storage medium 15 when the high voltage electric power source, which is the main source of the noise in the image forming apparatus, is not in operation, the weak signal used for information transmission is not subjected to the interference from the noise. Therefore, it is possible to improve reliability in inputting information into the storage medium 15, or outputting it therefrom.

Embodiment 4

Next, referring to FIGS. 8 and 9, the process cartridge and electrophotographic image forming apparatus in the fourth embodiment of the present invention will be described.

The image forming apparatus is a such an image forming apparatus that removably employs the process cartridge 14 in the first embodiment to carry out an image forming operation. It is characterized in that it comprising a means 17 for inputting information into the storage medium 15 of the process cartridge 14 and outputting it therefrom, and an auxiliary storing means 24, wherein control is executed in such a manner that information is temporarily stored in the auxiliary storing means 24 when the high voltage electric power source 18 mounted in the image forming apparatus main assembly is in operation, and the information is inputted into the storage medium 15 of the process cartridge 14 from the auxiliary storing means 24, or outputted therefrom, when the high voltage electric power source 18 is not in operation.

The image forming apparatus in this embodiment comprises the high voltage electric power source 18 for bias application, a laser beam projecting apparatus 9 for the formation of a charged latent image, a CPU 19, a control ROM 21, an RAM 24 as the auxiliary storing means, and a means 25 for inputting information into the RAM 24, and outputting it therefrom. Also, in the image forming apparatus, a sheet feeder cassette 20 for holding a recording sheet 12 as a recording medium, a transfer roller 22 for transferring a toner image onto the recording sheet 12, and a fixing device 23 for fixing the toner image to the recording sheet 12 are properly positioned, on the premise that in order to carry out an image forming operation, the process cartridge 14 in the first embodiment must be installed in the apparatus main assembly.

The CPU 19 controls the image formation sequence comprising bias application, recording sheet conveyance, and the like, on the basis of the control information stored in the control ROM 21. The inputting/outputting means 25 for exchanging information between the CPU 19 and the RAM 24 is disposed in a shield case 26 formed of 0.5 mm thick stainless steel, so that the information signal is rendered less liable to be affected by the noise which occurs when the high voltage electric power source 18 is in operation.

The content to be stored in the storage medium 15 is the information about the print count for the image forming apparatus.

Figure 9:
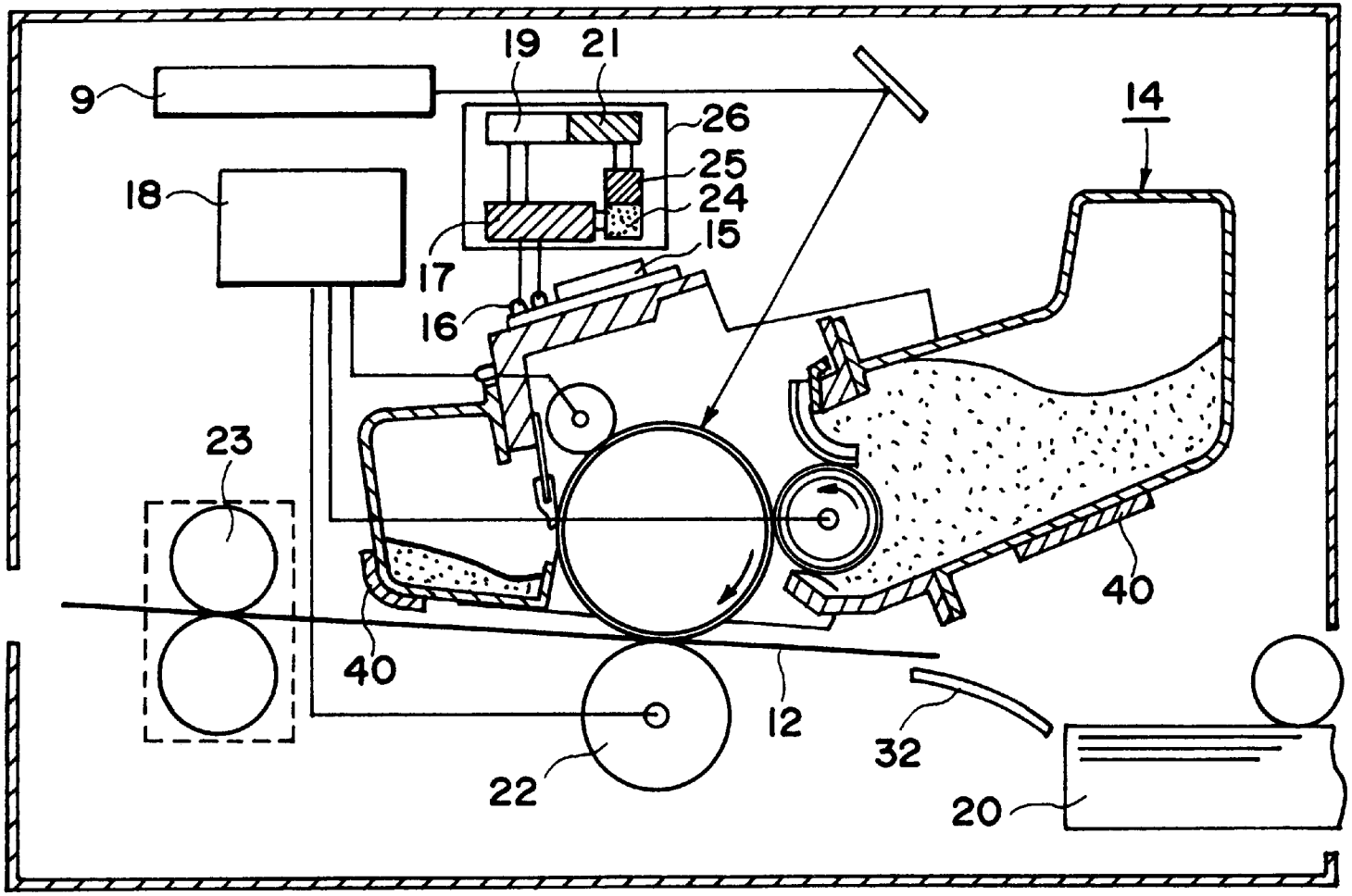
FIG. 9 is a sectional view of the image forming apparatus in a fifth embodiment of the present invention.

The information regarding the print count is inputted into the storage medium 15 mounted in the process cartridge 14 by the information inputting/outputting means 17, through a simple information transmission contact point 16 illustrated in FIG. 9. This information transmission contact point 16 makes contact with the contact point provided on the process cartridge 14 side, with a predetermined contact pressure, as the process cartridge 14 is installed into the main assembly of the image forming apparatus.

Figure 8:
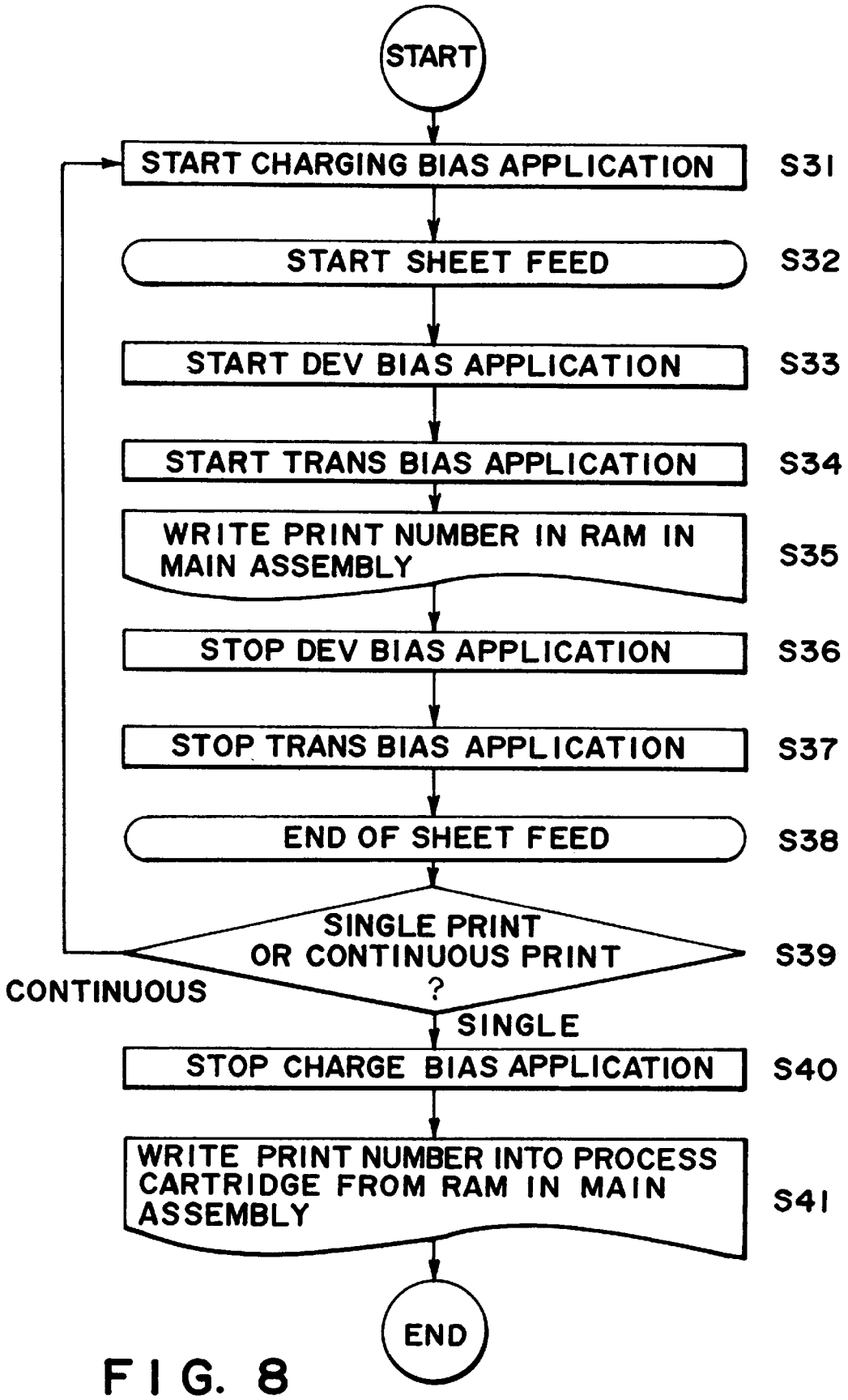
FIG. 8 is a flow chart for a fourth embodiment of the present invention, depicting the control flow for continuous image formation.

As depicted by the flow chart in FIG. 8, the image forming apparatus in this embodiment carries out image forming processes, such as applying a charge bias (S31), conveying a recording sheet (S32), applying a development bias (S33), applying a transfer bias (S34), in this order, and then, writes the print count information into the RAM 24 as the auxiliary storage medium (S35). Next, in stops the development bias application (S34) and transfer bias application (S37), and finishes conveying the recording sheet (S38). Thereafter, it makes a decision as to whether or not printing is to be continued (S39). When it determines that printing is not to be continued, it stops the charge bias application (S40). Then, it writes the information about the print count into the storage medium 15 of the process cartridge 14 from the RAM 24 of the apparatus main assembly.

When it is determined that printing is to be continued, the charge bias is applied again to charge the surface of the photosensitive drum 1, preparing it for the following image formation.

In this embodiment, since the information depicting the condition of the image forming apparatus is inputted in the storage medium 15 when the high voltage electric power source, which is the main source of the noise in the image forming apparatus, is not in operation, the weak signal used for information transmission is not subjected to the interference from the noise.

Further, when prints are continuously made, it is unnecessary to input the print count information into the storage medium 15 each time a print is finished. In other words, it does not need to be feared that unless the operation of the high voltage electric power source 18 is interrupted, the print count information might be lost due to the effect of the noise. Therefore, it is possible to apply a bias continuously, improving the image formation speed.

Further, the image forming apparatus in this embodiment is effective to increase the image formation speed while maintaining reliability in information transmission when it is necessary to store such information that changes for each print.

Further, it is obvious that the process cartridge in the third of fourth embodiment is compatible with the developing apparatus in the second embodiment.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

image forming means for forming an image on a recording material in the form of a sheet, wherein at least a part of said image forming means is unified into a unit which is detachably mountable relative to a main assembly of said image forming apparatus;

a high voltage electric power source for driving said image forming means;

storing means for storing information related to image formation, said storing means being mounted to said unit; and information inputting/outputting means for inputting the information into said storing means, or outputting it therefrom, by accessing said storing means, wherein, when, during continuous printing on a plurality of recording materials, said power source stops the supply of a high voltage to said image forming means for each of the recording materials, said inputting/outputting means inputs the information into said storing means.

2. An apparatus according to claim 1, wherein said image forming means comprises an electrophotographic photosensitive member, charging means for charging said photosensitive member, exposure means for exposing said photosensitive member to light to form a latent image, developing means for developing the latent image into a visualized image, image transfer means for transferring the visualized image from said photosensitive member onto a recording material, and cleaning means for cleaning said photosensitive member.

3. An apparatus according to claim 2, wherein said photosensitive member and at least one of said charging means, said developing means, said transfer means and said cleaning means, and said storing means constitute a unit which is detachably mountable to a main assembly of said image forming apparatus.

4. An apparatus according to claim 2, wherein said developing means and said storing means constitute a unit which is detachably mountable to a main assembly of said image forming apparatus.

5. An apparatus according to claim 2, wherein said high voltage source supplies a high voltage to at least one of said charging means, said developing means and said transfer means.

6. An apparatus according to claim 1, wherein said storing means includes a semiconductor memory.

* * * * *

UNITED STATES PATENT AND TRADEMARK OFFICE

CERTIFICATE OF CORRECTION

PATENT NO. : 5,926,665

DATED : July 20, 1999

INVENTOR(S): JUN SUZUKI

It is certified that error appears in the above-identified patent and that said Letters Patent is hereby corrected as shown below:

COLUMN 2:
Line 12, "vented" should read --vented.--.
Line 31, "counter measure" should read --countermeasure--.
Line 36, "Image" should read --image--.
Line 42, "counter measures" should read --countermeasures--.
and
Line 43, "the" should be deleted.

COLUMN 3:
Line 42, "united" should read --united.--.

COLUMN 4:
Line 56, "In" should read --in--.
Line 60, "(S5)" should read --(S8)--.

COLUMN 5:
Line 43, "In" should read --in--.

COLUMN 6:
Line 6, "Image" should read --image--.
Line 7, "Into" should read --into--.
Line 52, "a" should be deleted.
Line 56, "comprising" should read --comprises--.

UNITED STATES PATENT AND TRADEMARK OFFICE

CERTIFICATE OF CORRECTION

PATENT NO. : 5,926,665

DATED : July 20, 1999

INVENTOR(S): JUN SUZUKI

It is certified that error appears in the above-identified patent and that said Letters Patent is hereby corrected as shown below:

COLUMN 7:

Line 44, "in" should read --it--.

Signed and Sealed this

Twenty-fifth Day of July, 2000

*Attest:*

*Attesting Officer*

Q. TODD DICKINSON

*Director of Patents and Trademarks*